US005915344A

United States Patent [19]

Suzuki et al.

[11] Patent Number: 5,915,344

[45] Date of Patent: Jun. 29, 1999

[54] ENGINE COOLING APPARATUS FOR MOTORCYCLES

[75] Inventors: Tetsuya Suzuki; Koji Kano; Aiji Yamashita, all of Saitama, Japan

[73] Assignee: Honda Giken Kogyo Kabushiki Kaisha, Tokyo, Japan

[21] Appl. No.: 08/871,975

[22] Filed: Jun. 10, 1997

[30] Foreign Application Priority Data

Jun. 10, 1996 [JP] Japan ..... 8-147716

[51] Int. Cl.[6] ..... F01P 7/02

[52] U.S. Cl. ..... 123/41.11; 123/41.12

[58] Field of Search ..... 123/41.12, 41.11

[56] References Cited

U.S. PATENT DOCUMENTS

| | | | |
|---|---|---|---|
| 4,557,223 | 12/1985 | Gueyen | 123/41.12 |
| 4,823,744 | 4/1989 | Omura | 123/41.12 |
| 5,133,302 | 7/1992 | Yamada et al. | 123/41.12 |
| 5,307,644 | 5/1994 | Cummins et al. | 123/41.12 |
| 5,359,969 | 11/1994 | Dickrell et al. | 123/41.12 |
| 5,609,125 | 3/1997 | Ninomiya | 123/41.12 |

*Primary Examiner*—John Kwon

*Attorney, Agent, or Firm*—Birch, Stewart, Kolasch & Birch, LLP

[57] ABSTRACT

To minimize excessive temperature elevation when in a fast idle state for an engine covered with a cowling, and to prevent heat damage to the cowling, for motorcycles. A radiator and an electric radiator fan are positioned ahead of a watercooled engine and are installed inside a cowling C. When a transmission neutral sensor detects when the transmission is in neutral and a engine speed sensor detects a speed at or over a fast idle speed of the engine both output a high-level signal continuously for a specific length of time to a timer. This state is recognized as the fast idle state of the engine, the transistor is switched on, and the electric motor of the radiator fan 17 is actuated.

10 Claims, 11 Drawing Sheets

ENGINE COOLING APPARATUS FOR MOTORCYCLES

BACKGROUND OF THE INVENTION

1. Field of the Invention

The present invention relates to an engine cooling apparatus, in which a cooling fan capable of supplying cooling air to an engine during operation is provided on the inside of a cowling that-covers the engine, which is installed on a chassis frame.

2. Description of Background Art

Conventional engine cooling apparatus comprising a radiator that cooled the cooling water of the engine and an electric radiator fan that cooled this radiator by blowing air through it are widely known for motorcycles in which a water-cooled engine is covered by a cowling.

SUMMARY AND OBJECTS OF THE INVENTION

With the conventional engine cooling apparatus described above, in general, when the engine cooling water is at a relatively low temperature, the circulation of the cooling water through the engine is halted, the radiator fan is shut off, and the idle speed of the engine is set higher so as to promote engine warming.

However, during this engine warm-up, that is, in a fast idle state, the temperature of the exhaust pipe around its base rises particularly quickly and is therefore prone to overheating. Consequently, that portion of the synthetic resin cowling that is close to the exhaust pipe is backed with a heat-insulating sheet, for example, so as to prevent the cowling from being damaged by this heat, but this not only makes the construction of the cowling more complicated, but also leads to greater weight, which is undesirable.

It is an object of the present invention to provide the abovementioned motorcycle engine cooling apparatus, in which overheating when the engine is in a fast idle state can be prevented.

In order to achieve the stated object, the present invention provides an engine cooling apparatus for a motorcycle, in which a cooling fan capable of supplying cooling air to an engine during operation is provided on the inside of a cowling that covers the engine, which is installed on a chassis frame, the cooling fan is actuated at least when the engine is in a fast idle state. This allows the temperature of the engine to be prevented from rising excessively by the actuation of the cooling fan at least when the engine is in an idle state. Therefore, the cowling does not need to be protected from heat damage by the engine, which helps to make the construction thereof simpler and more lightweight.

In addition, the present invention provides that the fast idle state of the engine occurs when a state in which the transmission is in neutral and the engine speed is at or over the fast idle speed has continued for a specific length of time. This allows the idle state of the engine to be monitored simply and accurately.

Further, the present invention provides that the fast idle state of the engine occurs when a state in which the throttle valve of the engine is at or below the fast idle opening and the engine speed is at or over the fast idle speed has continued for a specific length of time. This allows the idle state of the engine to be monitored simply and accurately.

The present invention utilizes a cooling fan which is an electric radiator fan that blows air to the cooling radiator of a watercooled engine. This allows the radiator fan to be utilized to prevent excessive temperature elevation when the engine is in a fast idle state, and avoids making the construction more complicated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will be described with reference to the embodiments of the present invention illustrated in FIGS. 1–11.

Figure 1:
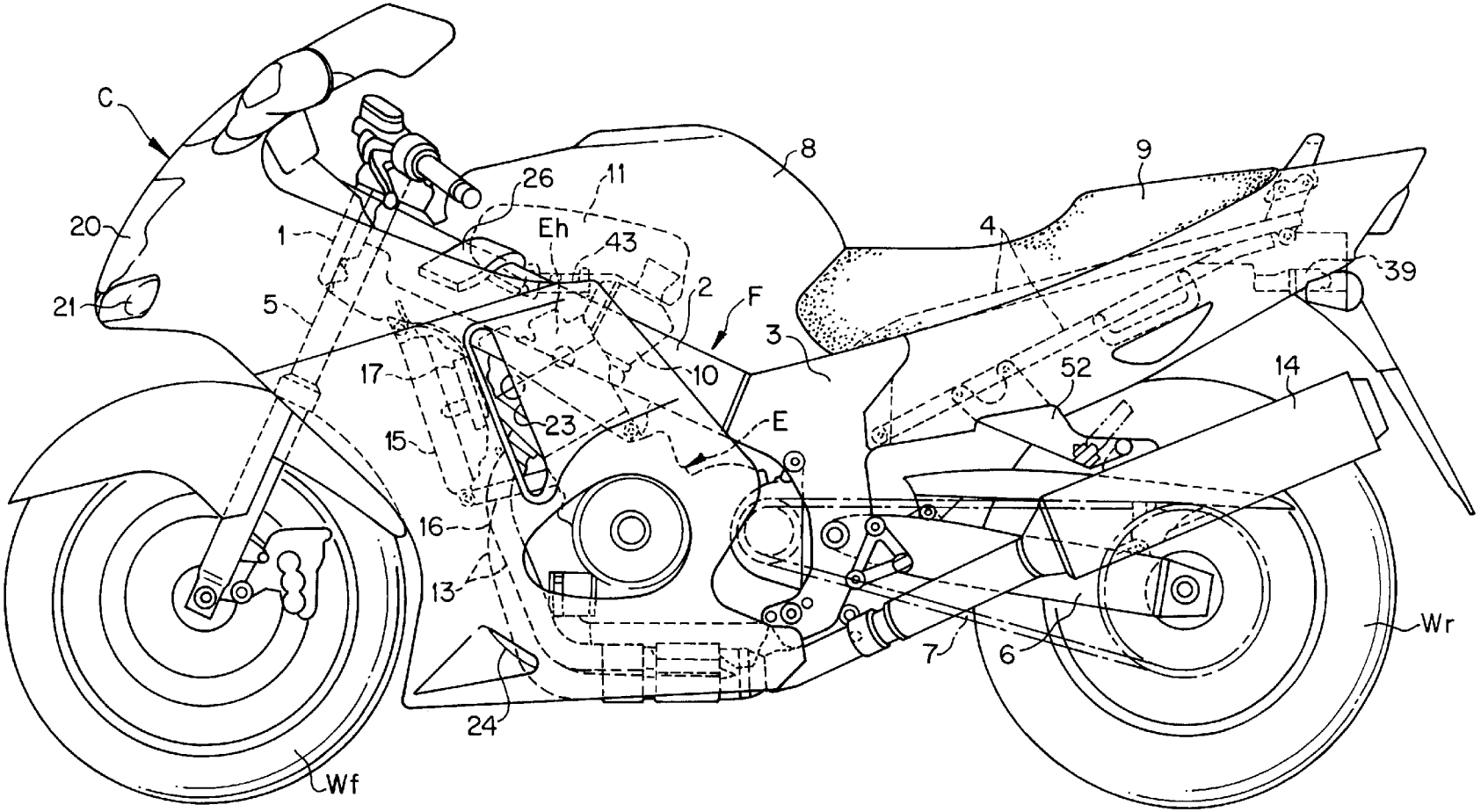
FIG. 1 is a side view of a motorcycle.
Figure 2:
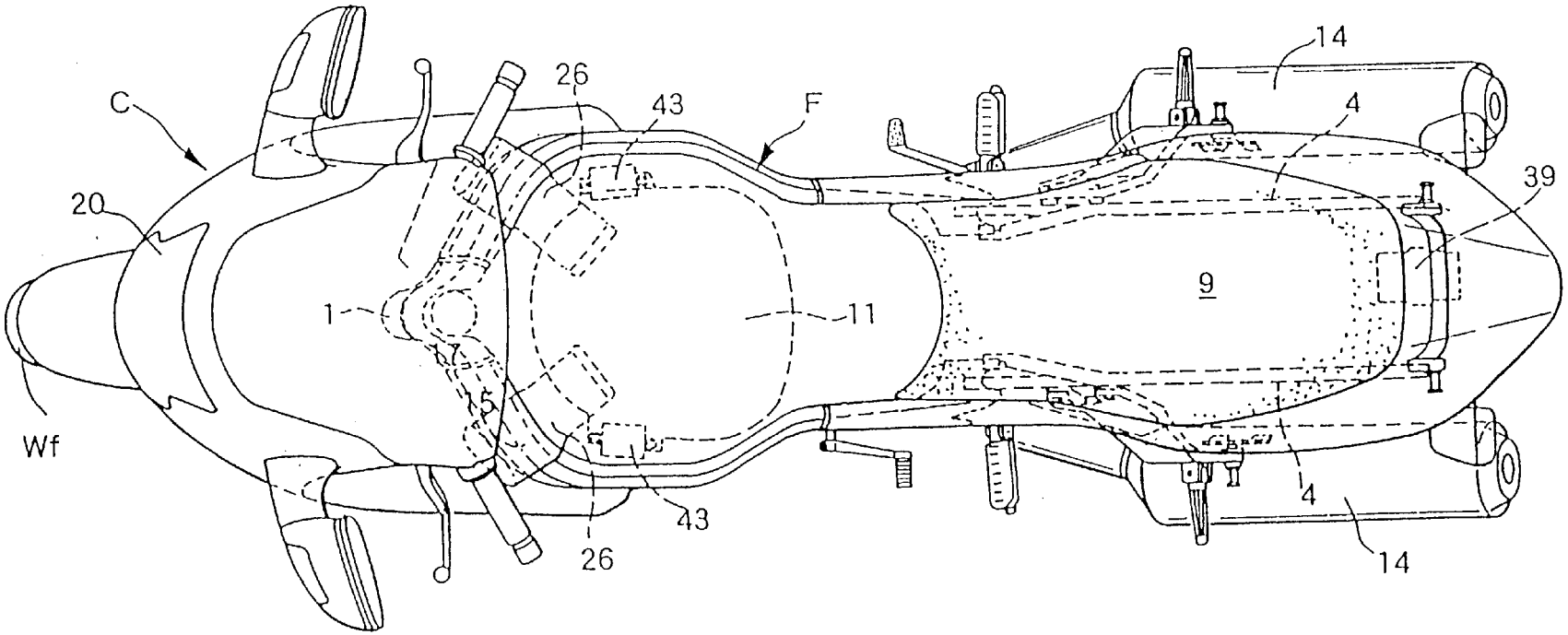
FIG. 2 is a plan view of the same motorcycle.
Figure 3:
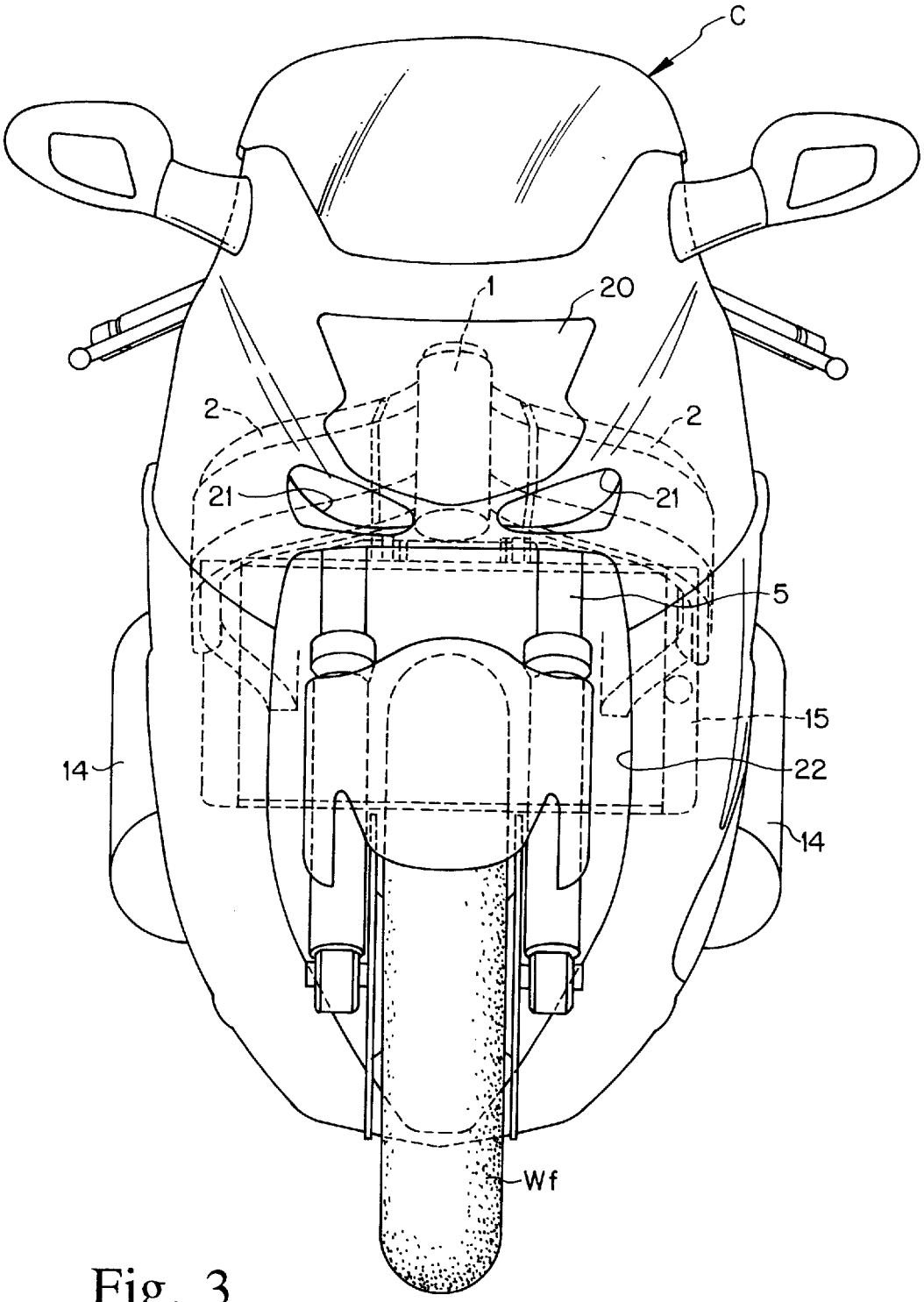
FIG. 3 is a front view of the same motorcycle.

FIGS. 1–3 illustrate a motorcycle wherein a chassis frame F comprises a head pipe 1, a pair of left and right main frames 2 that extend rearwardly from the head pipe 1 while being separated from one another. A pair of left and right center frames 3 are provided that are joined at the rear end of the main frames 2 and extend downwardly therefrom. A seat stay 4 is joined to the upper portions of the center frames 3 and extend rearwardly and slightly upwardly. A front fork 5 supports a front wheel Wf which is steerably supported by the head pipe 1. A rear fork 6 supports a rear wheel Wr that is supported so that it can swing up and down relative to the left and right center frames 3.

The engine E is a water-cooled, inline, multicylinder type (four cylinders in the illustrated example), which is positioned directly in front of the center frames 3 and between the main frames 2 so that a head Eh can be inserted. The engine E is bolted to the main frames 2 and center frames 3. The power of the engine E is transmitted to the rear wheel Wr through a transmission and a chain drive unit 7 that are incorporated into the engine E.

A fuel tank 8 is attached such that it spans the space between the tops of the left and right main frames 2, and a tandem seat 9 is attached to the top of the seat stay 4.

A multiple carburetor 10 is installed at the back side of the head Eh of the engine E. An air cleaner 11, provided with the intake guide openings 10*a* (see FIG. 5) of this multiple carburetor 10, is positioned between the main frames 2 so that it is covered by the fuel tank-8. Rubber mounts are provided at several points for connecting the air cleaner 11 to the head Eh of the engine E.

A plurality of exhaust pipes 13, are mounted on the front of the head Eh of the engine E. The exhaust pipes 13 are positioned directly beneath the engine E, from where they branch off in two sets to the left and right. Thereafter the exhaust pipes 13 are connected to a pair of left and right exhaust mufflers 14 positioned on the outside of and to the left and right of the rear wheel Wr.

Figure 4:
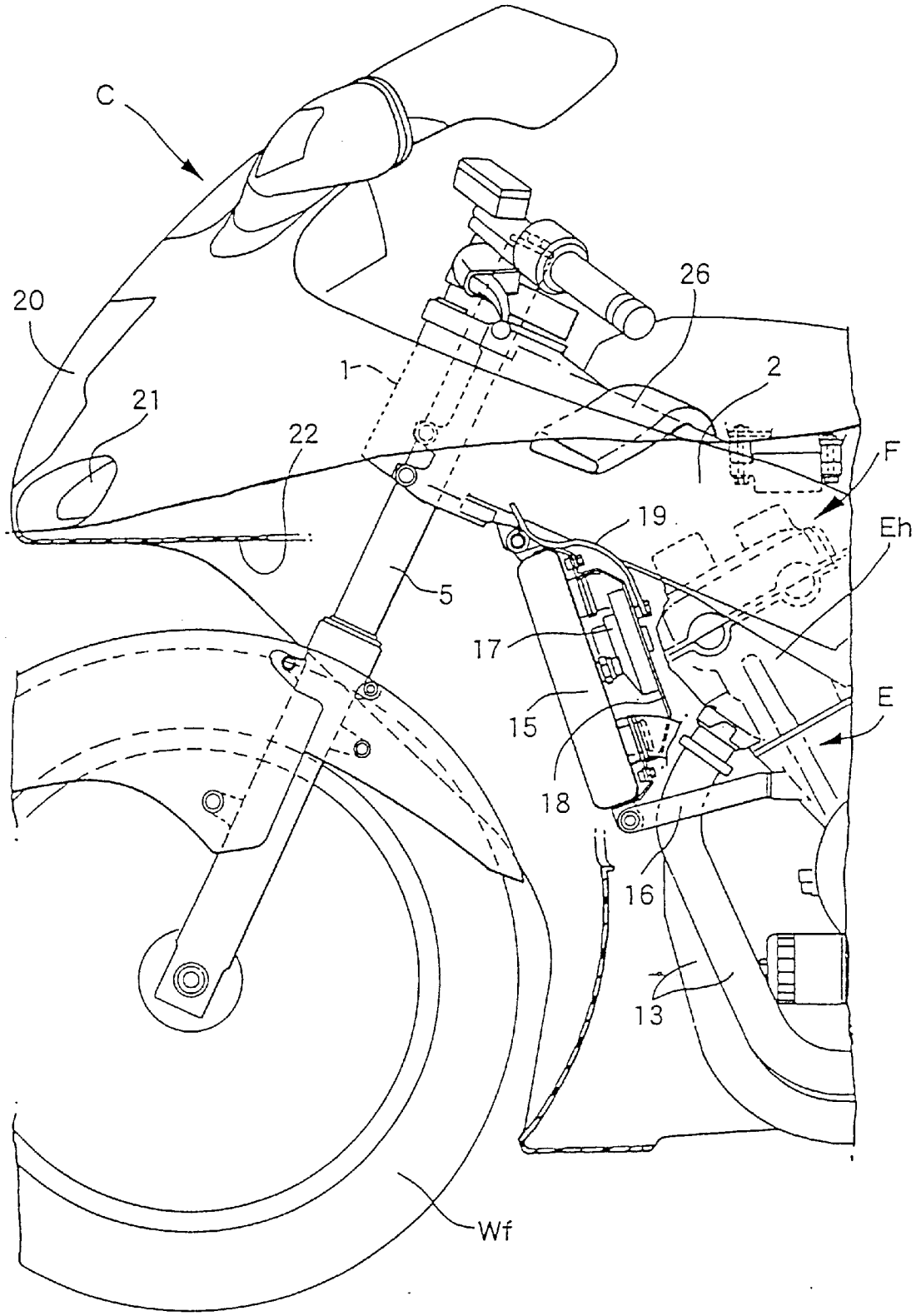
FIG. 4 is side view of the front portion of the same motorcycle, with part cut away vertically.

Referring to FIG. 4, a radiator 15 is positioned across from the front of the head Eh of the engine E. The radiator 15 is supported at its top by the main frames 2 and at its bottom by the engine E via a stay 16. An electric radiator fan 17 (cooling fan) is positioned to the rear of the radiator 15 and is supported by the radiator 15 via a fan cover 18. As is the usual practice, the radiator 15 is connected to the cooling water channel of the engine E. When this cooling water reaches a specific high temperature, the cooling water is circulated between the engine E and the radiator is to effect cooling. The actuation of the radiator fan 17 causes air to flow from the front to the rear of the radiator 15, which promotes the radiation of heat from the radiator 15 and enhances the engine cooling effect. A heat guard plate 19 blocks the radiated heat from the head Eh of the engine E and is installed on the top rear surface of this radiator 15.

A cowling C covers the engine E and the radiator 15 from the upper front surface of the front fork 5 and is attached to the chassis frame F and the engine E. A headlight 20 is attached to the front wall of this cowling C such that the lens surface thereof is contiguous with the outer surface of front wall. Intake air scoops 21 for the engine E are provided directly beneath the headlight 20. A main cooling air scoop 22 is provided to open towards the radiator 15 and the engine E. A first auxiliary cooling air scoop 23, opens towards the head Eh of the engine E, and a second auxiliary cooling air scoop 24, opens towards the exhaust pipes 13. The first and second auxiliary cooling air scoops 23, 24 are provided to the left and right side walls of the cowling C, respectively. The rear of the cowling C is open. Therefore, the air that flows from the abovementioned cooling air scoops 22, 23, and 24 through the cowling C cools the radiator 15 and the engine E, and then exits to the rear of the cowling C.

Figure 5:
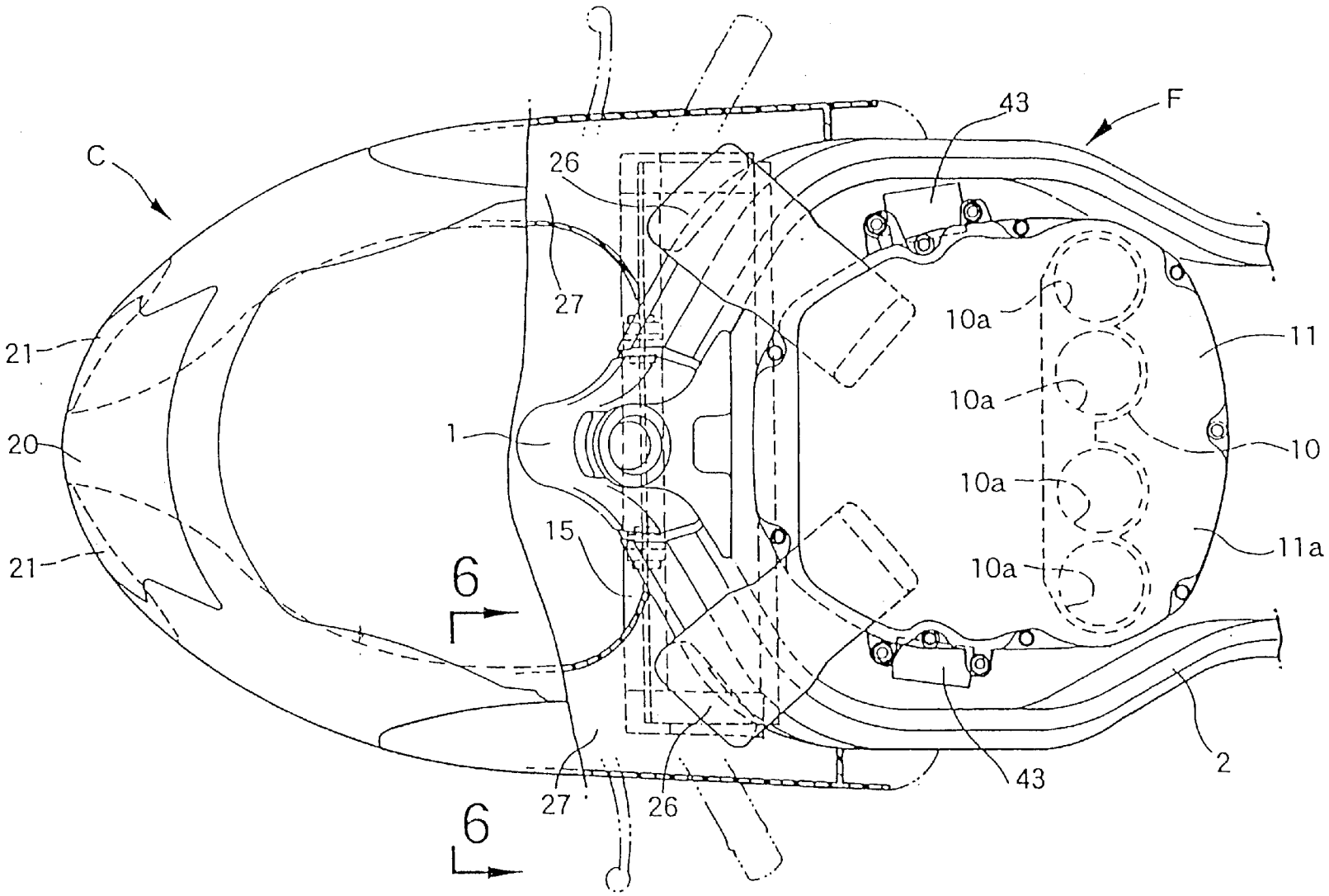
FIG. 5 is a plan view of the front portion of the same motorcycle, with the fuel tank removed.
Figure 6:
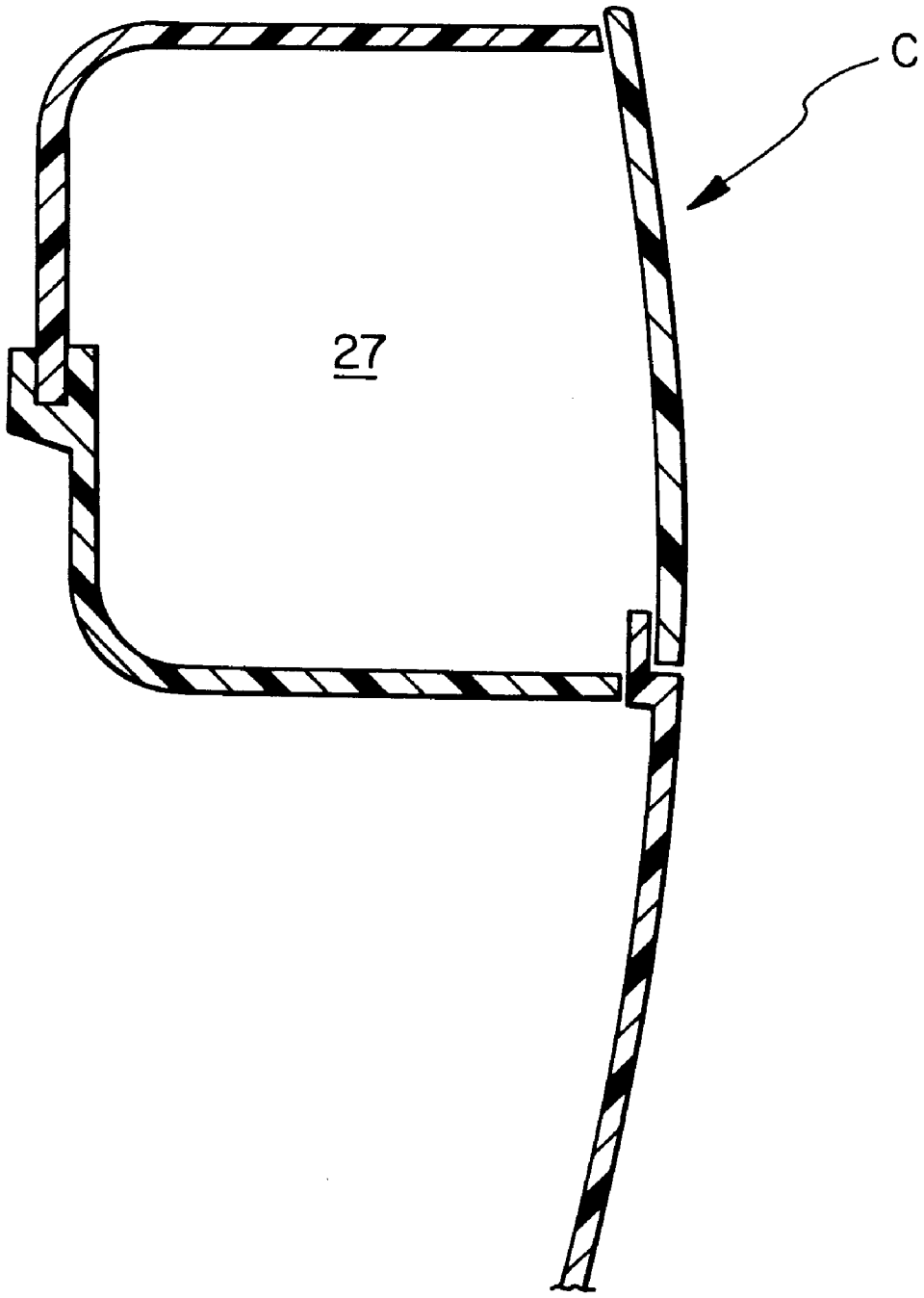
FIG. 6 is a cross section along the 6—6 line in FIG. 5.

As shown in FIGS. 5 and 6, a pair of left and right intake chambers 27 are formed in the left and right side walls of the cowling C that each communicate with one of the above-mentioned pair of intake air scoops 21. Rear ends of the left and right intake chambers 27 open near the front of the left and right main frames 2. The air cleaner 11 is provided with a pair of left and right intake ducts 26 that project through the front wall of the cleaner case 11*a* of the air cleaner 11. The intake ducts 26 extend forward so that they each straddle the respective main frame 2 on the same side. The inlets of the intake ducts 26 at the front ends thereof each protrude into the intake chamber 27 on the same side.

The relatively clean, low-temperature air that is brought in from the intake air scoops 21 is accumulated in the intake chambers 27 virtually without being affected by the heat of the engine E. This air is drawn from the intake ducts 26 into the engine E through the air cleaner 11 and then the carburetor 10. In this way, the intake temperature can always be kept low and the effect of the dynamic pressure of the traveling air on the intake pressure can be eliminated. Thus, the intake characteristics of the engine E are more stable. Furthermore, since the cowling C is utilized to form the intake chambers 27, the construction of the intake chambers 27 is simpler. In addition, the dead space within the cowling C is utilized more efficiently, which helps make the motorcycle more compact.

Figure 7:
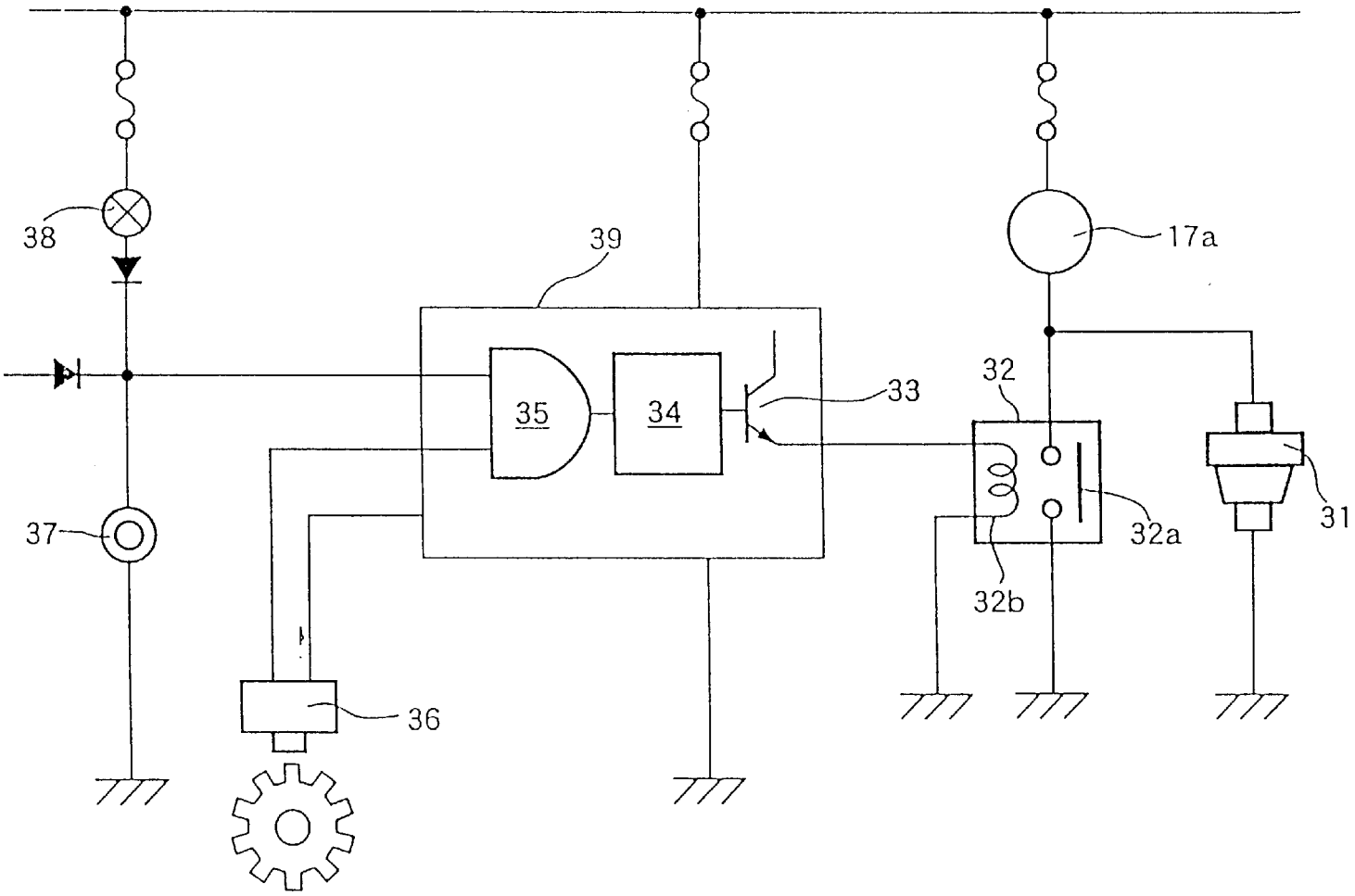
FIG. 7 is a drive control circuit diagram of the electric motor of the radiator fan.

FIG. 7 illustrates the actuation control circuit for the electric motor of the abovementioned radiator fan 17. A thermoswitch 31 is connected in parallel to the contact 32*a* of a relay 32 in the electrical circuit of the electric motor 17*a*. The thermoswitch 31 is operatively connected to the engine E, and is designed to switch on when the cooling water temperature is 100° C. or higher. An on-off transistor 33 is connected to the electrical circuit going to the coil 32*b* of the relay 32, and a timer 34 and an AND circuit 35 are connected, in that order, to the base side of the transistor 33. The output signal of the engine speed sensor 36 is inputted to one of the input terminals of the AND circuit 35, and the output signal of a transmission neutral sensor 37 is inputted to the other input terminal.

The engine speed sensor 36 is designed to detect a speed at or over the fast idle speed (2000 rpm, for example) of the engine E and to output a high-level signal, while the transmission neutral sensor 37 is designed to detect when the transmission incorporated into the engine E is in neutral and to output a highlevel signal. The output signal of this transmission neutral sensor 37 is also used to light a neutral lamp 38 which indicates that the transmission is in neutral.

The timer 34 is designed to output a high-level signal during this sustained period when an input signal thereto is sustained for a specific length of time (such as 10 seconds).

The electric motor 17*a* is actuated by the switching on of the thermoswitch 31 when the cooling water of the engine E reaches or exceeds 100° C., and is also actuated when the engine E is in a fast idle state. Specifically, when the engine speed reaches the fast idle speed and the engine speed sensor 36 outputs a high-level signal, and, at the same time, the transmission is in neutral-and the transmission neutral sensor 37 outputs a high-level signal, the AND circuit 35 outputs a highlevel signal to the timer 34 upon receiving these two output signals. When this state has continued for at least a specific length of time it is recognized as a fast idle state, and the timer 34 outputs an ON command signal, the transistor 33 that receives this command is turned on and actuates the relay 32, and the electric motor 17*a* is actuated.

Therefore, while the engine E is being warmed up, even in a state in which the cooling water thereof has not yet warmed sufficiently and the circulation of the cooling water between the engine E and the radiator 15 has not begun, if the engine E is in a fast idle state, then the actuation of the radiator fan 17 by the drive of the electric motor 17*a* will supply cooling air around the head Eh of the engine E, and particularly to the upstream portion of the exhaust pipes 13, allowing the excessive temperature elevation at this portion to be suppressed.

The above-mentioned AND circuit 35, the timer 34, and the transistor 33 are incorporated into the ignition unit 39 of the engine E, which allows for a partial sharing of the circuitry.

Figure 8:
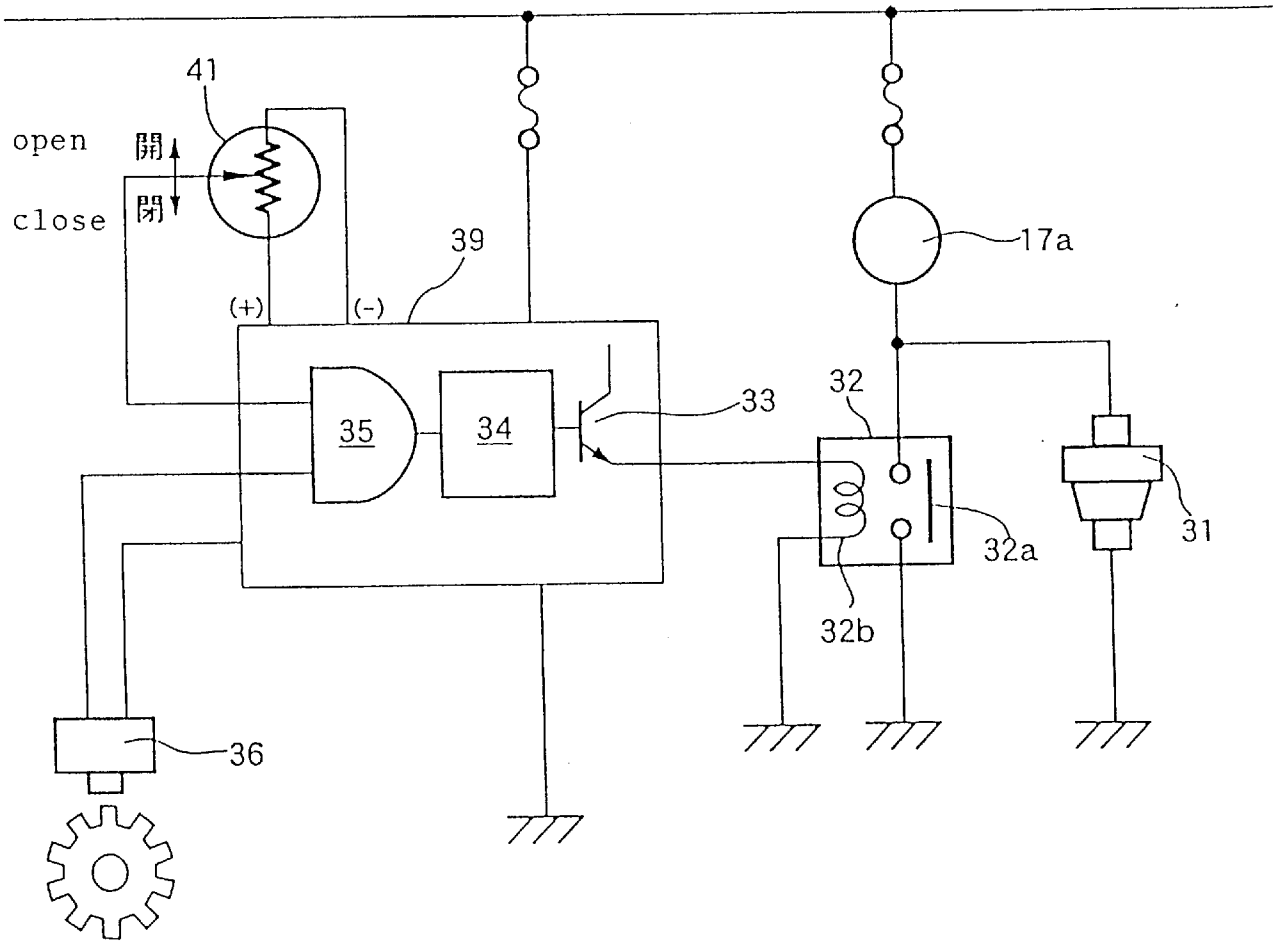
FIG. 8 is a circuit diagram of the same drive control circuit in a modified example.

FIG. 8 illustrates a modified example of the drive control circuit of the abovementioned electric motor 17*a*, in which a throttle sensor 41, which detects a state in which the throttle valve in the abovementioned carburetor 10 is below the fast idle opening and outputs a high-level signal, is provided instead of the transmission neutral sensor 37 used in the previous example. The rest of the structure is the same as in the previous example. Components in FIG. 8 which correspond to the previous example are labeled with the same numbers.

In this modified example, when a state in which the throttle valve opening of the carburetor 10 is at or below the fast idle opening and the engine speed is at or above the fast idle speed which continues for a specific length of time, this state is recognized as the fast idle state of the engine E. The electric motor 17*a* is actuated just as in the previous example, and the radiator fan 17 is driven.

Figure 9:
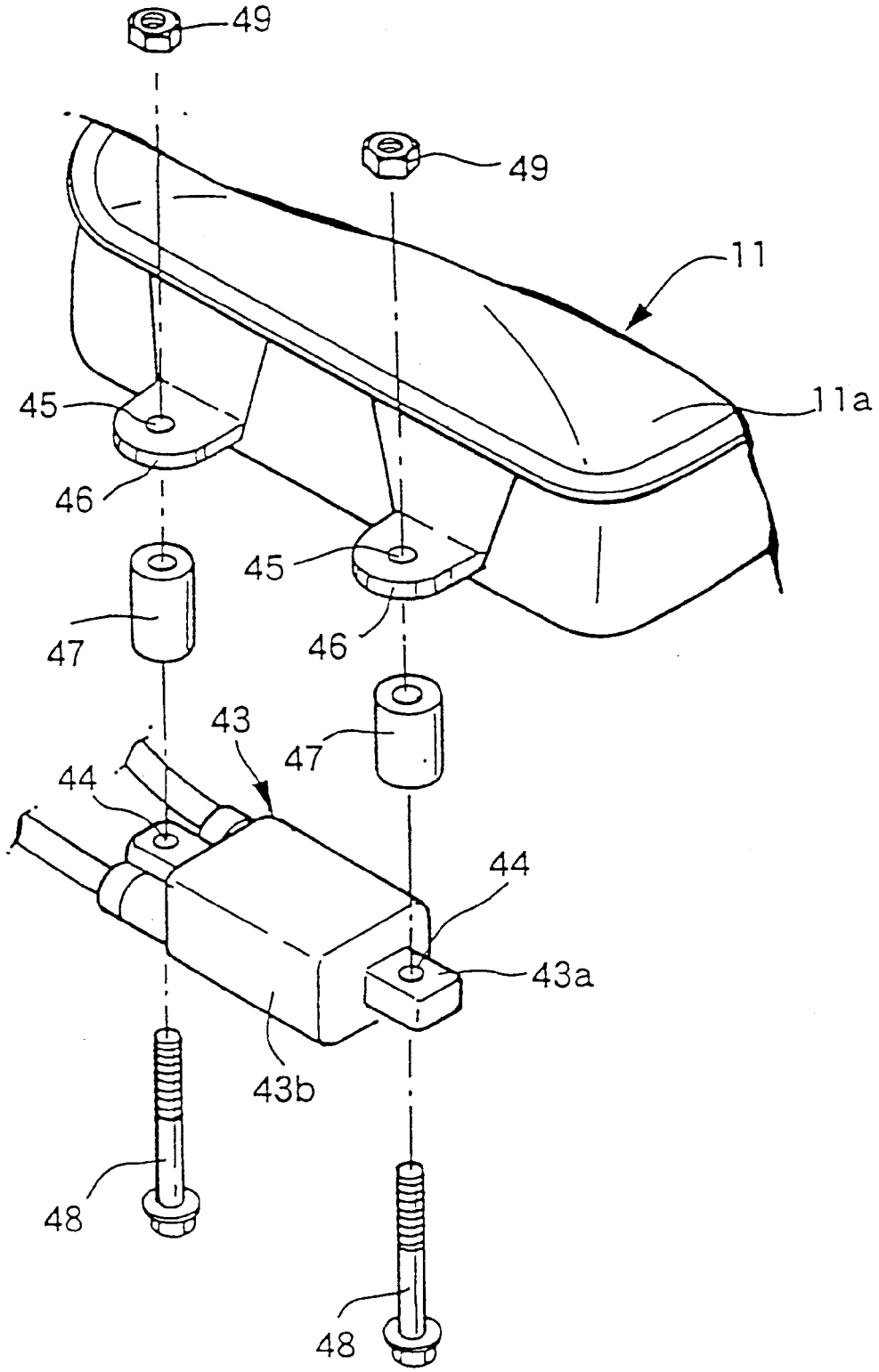
FIG. 9 is an exploded oblique view of the attachment structure of the engine ignition coil.

FIG. 9 illustrates the attachment structure of an engine ignition coil 43. The ignition coil 43 includes a core 43*a* and a coil component 43*b* that is wound around the core 43*a*. Attachment holes 44 are provided at both ends of the core 43*a*, which stick out from the end faces of the coil component 43*b*. A pair of brackets 46 having attachment holes 45 are integrally molded on the synthetic resin cleaner case 11*a* of the abovementioned air cleaner 11 as the support components for the ignition coil 43. The two ends of the core 43*a* are positioned under the brackets 46 with distance collars 47 in between. The core 43*a* is fastened to the brackets 46 by bolts 48 that pass through the attachment holes 44 and 45 and the distance collars 47 and by nuts that are threaded onto these bolts.

If the synthetic resin cleaner case 11*a* is thus utilized as the support component for the ends of the core, the cleaner case 11*a* will double as a magnetic shield member between the two ends of the core 43*a*, so any decrease in the performance of the ignition coil 43 that would otherwise be caused by the effect of core loss or eddy current loss can be prevented with a simple construction. Also, in this example, as shown in FIG. 5, if the ignition coil 43 is positioned close to the above-mentioned intake ducts 26 so as to generate an air flow around the ignition coil 43 through the intake action of the intake ducts 26, then the ignition coil 43 will also be favorably cooled.

Figure 10:
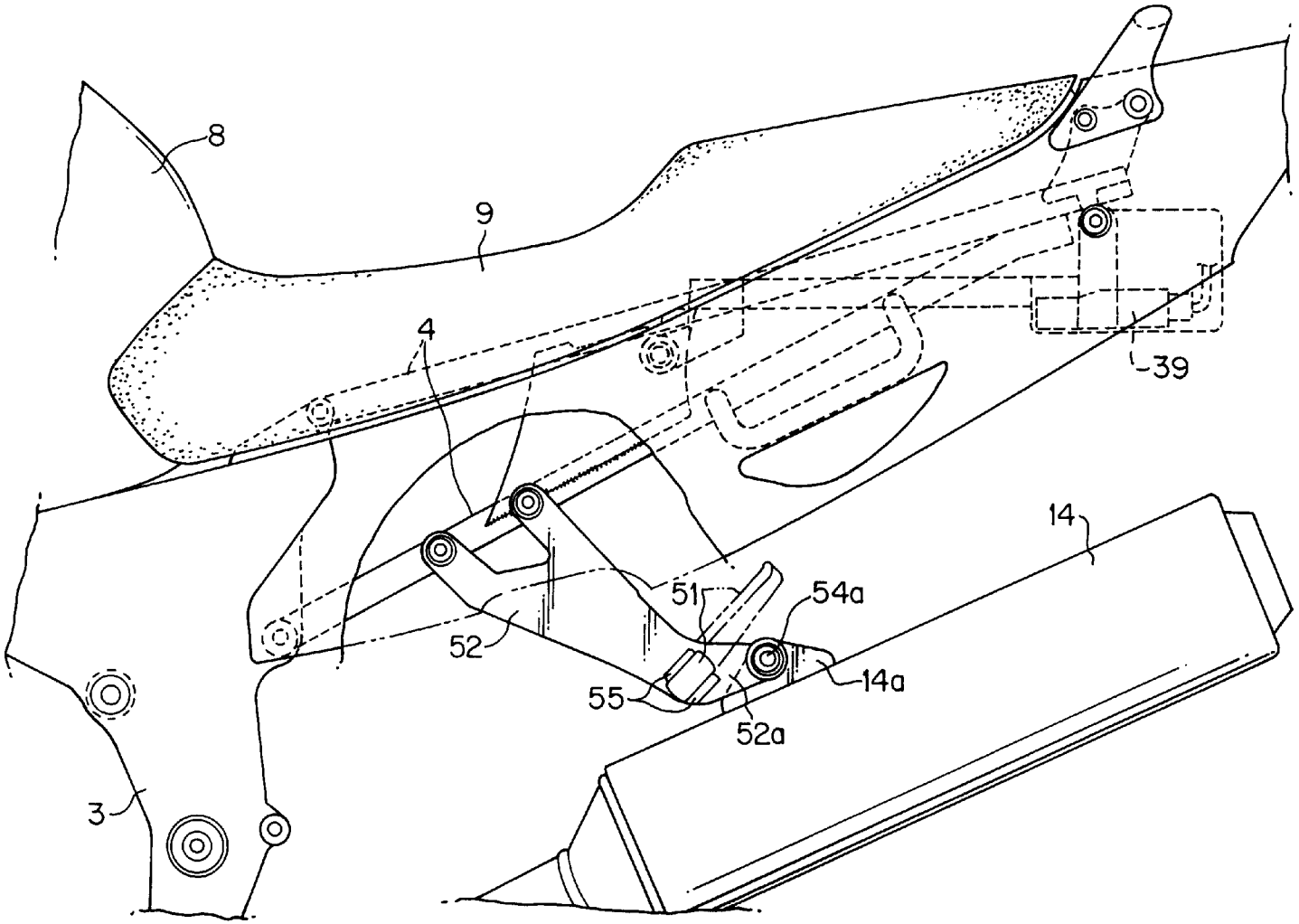
FIG. 10 is a side view of the exhaust muffler and pillion step attachment components in the abovementioned motorcycle.
Figure 11:
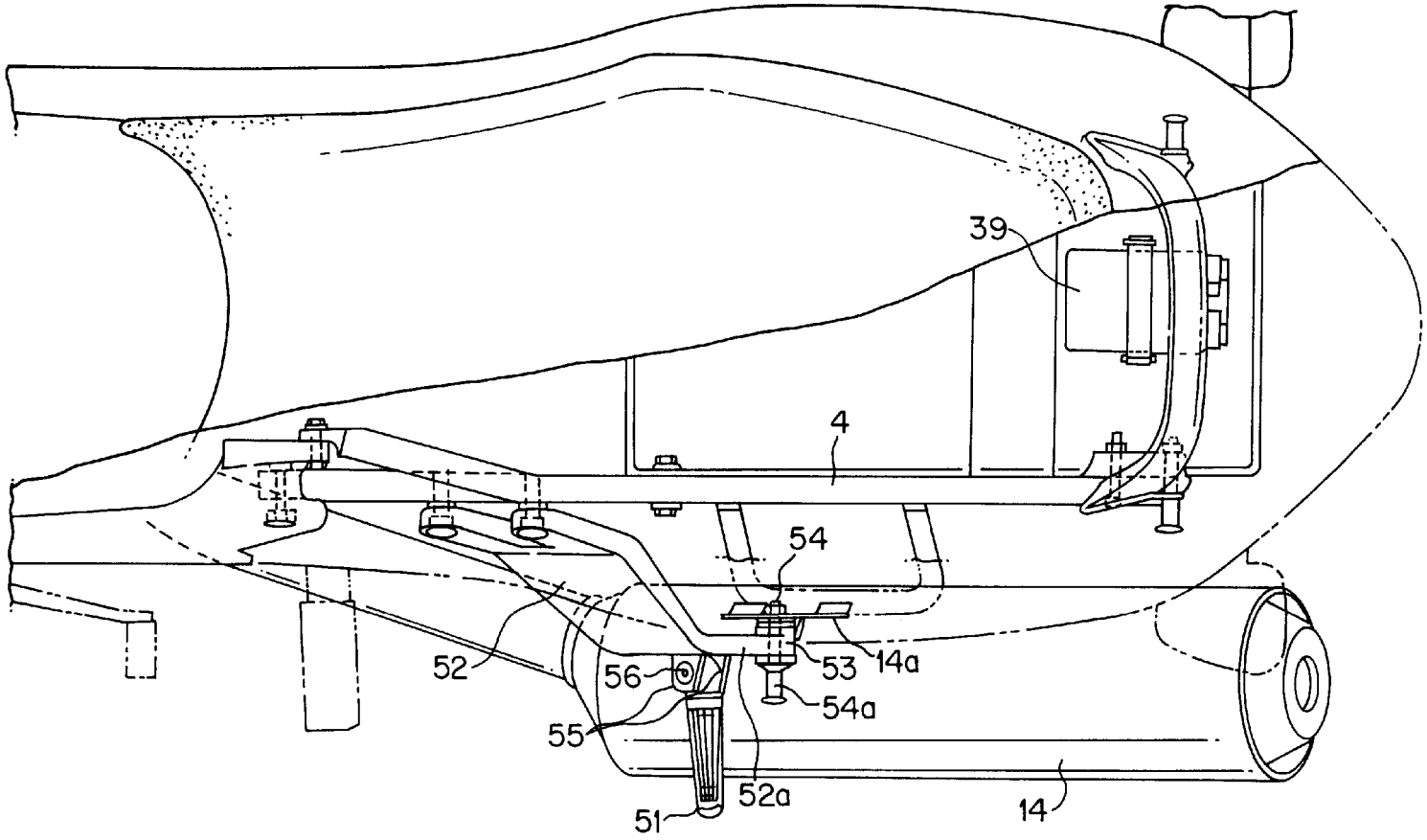
FIG. 11 is a plan view of the same attachment components.

FIGS. 10 and 11 illustrate the attachment structure of the above-mentioned exhaust mufflers 14 and pillion steps 51. A pair of left and right brackets 52, positioned on the outside of the rear wheel Wr, are affixed to the abovementioned seat stay 4. Each bracket 52 has at its lower end a rearwardly curving component 52*a*. A support tab 14*a* projects from the upper surface of the exhaust muffler 14 on the same side and is affixed by an attachment bolt 54 to a boss 53 on the rear end of this rearwardly curving component 52*a*. An extension shaft 54*a* projects from the bracket 52 away from the chassis and is integrally formed on this attachment bolt 54.

The rearwardly curving component 52*a* is provided with a pair of upper and lower support tabs 55 that are ahead of and adjacent to the abovementioned boss 53. The pillion step 51 is attached to the tabs 55 by a hinge pin 56. The pillion step 51 can be rotated between a usage position, in which the step sticks out from the bracket 52 away from the chassis, and a storage position, in which the step is folded rearwardly and upwardly.

When the passenger riding on the rear of the tandem seat 9 places his or her booted feet on the pillion steps 51, the heels of the boots hook over the extension shafts 54*a* of the abovementioned attachment bolts 54, which prevents the heels from damaging the exhaust mufflers 14. The attachment bolts 54 are used for the exhaust mufflers 14 and thus double as protective members for the exhaust mufflers 14. There is no need for dedicated protective members to be provided, so the number of parts can be minimized.

The present invention is not limited to the above embodiment, and a variety of design variations are possible within the scope of the essence of the present invention. For instance, the radiator fan 17 can be linked to the rotational member of the engine E via a clutch, and the actuation of the radiator fan 17 can be controlled by engaging and disengaging the clutch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine cooling apparatus for a motorcycle comprising:

a fan operatively positioned adjacent to an engine of a motorcycle for supplying a cooling flow of air the engine;

a cowling operatively positioned adjacent to said fan and said engine for shielding the engine from the environment; and an actuation control for selectively engerizing said fan at least when the engine is in a fast idle state.

2. The engine cooling apparatus for a motorcycle according to claim 1, wherein the fast idle state of the engine occurs when a transmission operatively connected to the engine is in neutral and a predetermined time elapses when the speed of the engine is at or over the fast idle speed.

3. The engine cooling apparatus for a motorcycle according to claim 1, wherein the fast idle state of the engine occurs when a throttle valve operatively connected to the engine is at or below a fast idle opening and a predetermined time elapses when the engine speed is at or over the fast idle speed.

4. The engine cooling apparatus for a motorcycle according to claim 1, wherein the cooling fan is an electric radiator fan for forcing air to cool the engine.

5. The engine cooling apparatus for a motorcycle according to claim 1, wherein said actuation control is an electrical circuit operatively connected to said fan and said engine for selectively energizing said fan.

6. The engine cooling apparatus for a motorcycle according to claim 5, and further including an on-off transistor operatively connected to a coil of a relay and a timer and an AND circuit, an output speed of the engine being inputted to one of the input terminals of the AND circuit and an output signal of a transmission being operatively connected to the engine being inputted to the other input terminal of the AND circuit.

7. The engine cooling apparatus for a motorcycle according to claim 5, wherein an output speed over 2,000 rpm is a fast idle state.

8. The engine cooling apparatus for a motorcycle according to claim 6, and further including a thermoswitch operatively connected to the engine and said fan being energized when the thermoswitch reaches or exceeds 100 degrees C.

9. The engine cooling apparatus for a motorcycle according to claim 1, further comprising:

a transmission neutral sensor for outputting a signal when a transmission operatively connected to the engine is in neutral; and an engine speed sensor for outputting a signal when the engine speed is at or over a fast idle speed, wherein said fan is energized when the transmission is in neutral and the engine is at or over a fast idle speed for a predetermined period of time.

10. The engine cooling apparatus for a motorcycle according to claim 9, further comprising a thermoswitch operatively connected to the engine for sensing the temperature of the engine, and wherein said fan is energized either one when the temperature reaches or exceeds 100° C. and when the transmission is in neutral and the engine is at over said fast idle speed for said predetermined period of time.

* * * * *